US006796108B2

(12) United States Patent
Jorba Ribes et al.

(10) Patent No.: US 6,796,108 B2
(45) Date of Patent: Sep. 28, 2004

(54) METHOD AND APPARATUS FOR CONTROLLING THE FILLING OF CONTAINERS UNDER ASEPTIC CONDITIONS

(75) Inventors: Javier Jorba Ribes, Barcelona (ES); José R. Sanchez Sabate, Barcelona (ES); Ramón Morales Pérez, Barcelona (ES)

(73) Assignee: Probitas Pharma S.A., Barcelona (ES)

( * ) Notice: Subject to any disclaimer, the term of this patent is extended or adjusted under 35 U.S.C. 154(b) by 0 days.

(21) Appl. No.: 10/389,339

(22) Filed: Mar. 14, 2003

(65) Prior Publication Data

US 2003/0188512 A1 Oct. 9, 2003

(30) Foreign Application Priority Data

Mar. 26, 2002 (ES) ..... 200200719

(51) Int. Cl.[7] ..... B65B 55/04

(52) U.S. Cl. ..... 53/507; 53/425; 53/426; 53/411; 53/415; 53/131.3; 53/136.1; 53/75; 53/495; 53/493; 53/282; 53/284.6; 53/508

(58) Field of Search ..... 53/425, 426, 75, 53/411, 415, 131.3, 136.1, 77, 495, 493, 282, 284.6, 167, 507–508

(56) References Cited

U.S. PATENT DOCUMENTS

| | | | | | |
|---|---|---|---|---|---|
| 3,012,386 | A | * | 12/1961 | Pechmann et al. | 53/411 |
| 3,526,773 | A | * | 9/1970 | Davis | 250/566 |
| 3,577,701 | A | * | 5/1971 | Bott et al. | 53/131.3 |
| 3,940,909 | A | * | 3/1976 | Cioni et al. | 53/167 |
| 5,427,161 | A | * | 6/1995 | Luhmann et al. | 141/144 |
| 5,538,054 | A | * | 7/1996 | L uhmann et al. | 141/198 |
| 5,673,535 | A | * | 10/1997 | Jagger | 53/282 |
| 6,115,990 | A | * | 9/2000 | Vogelsanger | 53/53 |
| 6,256,964 | B1 | * | 7/2001 | Drevfors | 53/426 |
| RE37,829 | E | * | 9/2002 | Charhut et al. | 700/216 |
| 6,469,729 | B1 | * | 10/2002 | Ryan | 347/248 |
| 6,494,238 | B2 | * | 12/2002 | Sindermann | 141/6 |
| 6,535,637 | B1 | * | 3/2003 | Wootton et al. | 382/190 |
| 6,536,188 | B1 | * | 3/2003 | Taggart | 53/425 |

* cited by examiner

*Primary Examiner*—Scott A. Smith
*Assistant Examiner*—Michelle Lopez
(74) *Attorney, Agent, or Firm*—Darby & Darby

(57) ABSTRACT

The method comprises viewing by of a magnetic recording camera the zone for the opening of vials and for metered filling thereof and continuously recording the zones visually during the operation of the installation and simultaneously carrying out the identification marking of each full glass container, with indelible marking means, at the outlet of the installation.

5 Claims, 3 Drawing Sheets

METHOD AND APPARATUS FOR CONTROLLING THE FILLING OF CONTAINERS UNDER ASEPTIC CONDITIONS

SPECIFICATION

The present invention relates to a method and its apparatus for controlling the filling, under aseptic conditions, of containers such as flasks or vials of pharmaceutical products, intended to contain products that are sterilized, for example, by filtration.

As is known, there are products which by their nature cannot be sterilized by heating, so that sterilization thereof is carried out by filtration. In the processing of these flasks or vials which contain the aforesaid products, what is of special importance is the process of metered filling into the aforesaid containers, which have previously been washed and sterilized so that no particles may enter which could contain pathogenic germs.

For this reason, the flasks and their stoppers are sterilized in an autoclave and the liquid intended for them is sterilized by filtration.

In the customary process, the flasks and their stoppers emerge from the autoclaving step under sterile conditions and the flasks are partially capped. In the metered filling step, a critical stage is entered in which the metering machine removes the lids from the flasks, proceeds to introduce the liquid for each of them individually, and covers them again. Therefore, during the time when the flask is not covered over, there is a risk of contamination occurring, even though the process is carried out under a flow of suitably filtered air.

The method of the present invention relates to the problem mentioned previously, making it possible to identify each flask or vial, relating it precisely to the moment at which it was filled and making it possible to display a posteriori the actual filling step, all this leading to the result that in a hypothetical case of some contamination being discovered once the containers have been marketed, there is a possibility of determining very precisely when the filling of the contaminated container took place, which will make it possible to check the containers immediately preceding and following it, in order to ensure that the contamination has not extended to a larger number of containers, and will likewise make it possible to observe the metered filling step which took place, in order to locate any possible failure which produced the contamination and in this way enable this possible cause of contamination to be corrected.

In order to achieve its objectives, the method of the present invention comprises the combination of: a) an operation of indelible marking, on the glass of the container, of the desired identification data, which customarily comprise the product batch, a sequential filling number, and the hour, minute and second of filling, with b) a recording on magnetic tape, by means of a television camera, of the operation of filling all the units which comprise the product batch, so that the recording is carried out continuously during the operation of the installation, recording the metered filling operation continuously, making it possible a posteriori to relate any flask, identified by the indelibly marked inscriptions, to the work carried out in the installation in the corresponding area of the recording which is kept on magnetic tape, thereby making it possible to study the metered filling step thoroughly in order to locate the cause of the contamination in the event that this has occurred during the filling step.

The timing devices for the marking of the flasks and for the taking of pictures with the television camera are synchronized so that there is precise correspondence in time, making it possible to relate any container to a precise, specific area of the magnetic tape which is retained during the entire expiry period of the product, forming part of the documentation of each batch.

The marking of the glass flasks will be carried out indelibly, for example by means of etching by laser. However, any system of marking, for example by means of special dyes, marks made by products for chemically attacking the glass, or any other, may be used in the execution of the method of the invention, provided that they are totally indelible.

For greater understanding, some drawings corresponding to a preferred embodiment of the present invention are appended by way of a non-limiting explanatory example.

Figure 1:
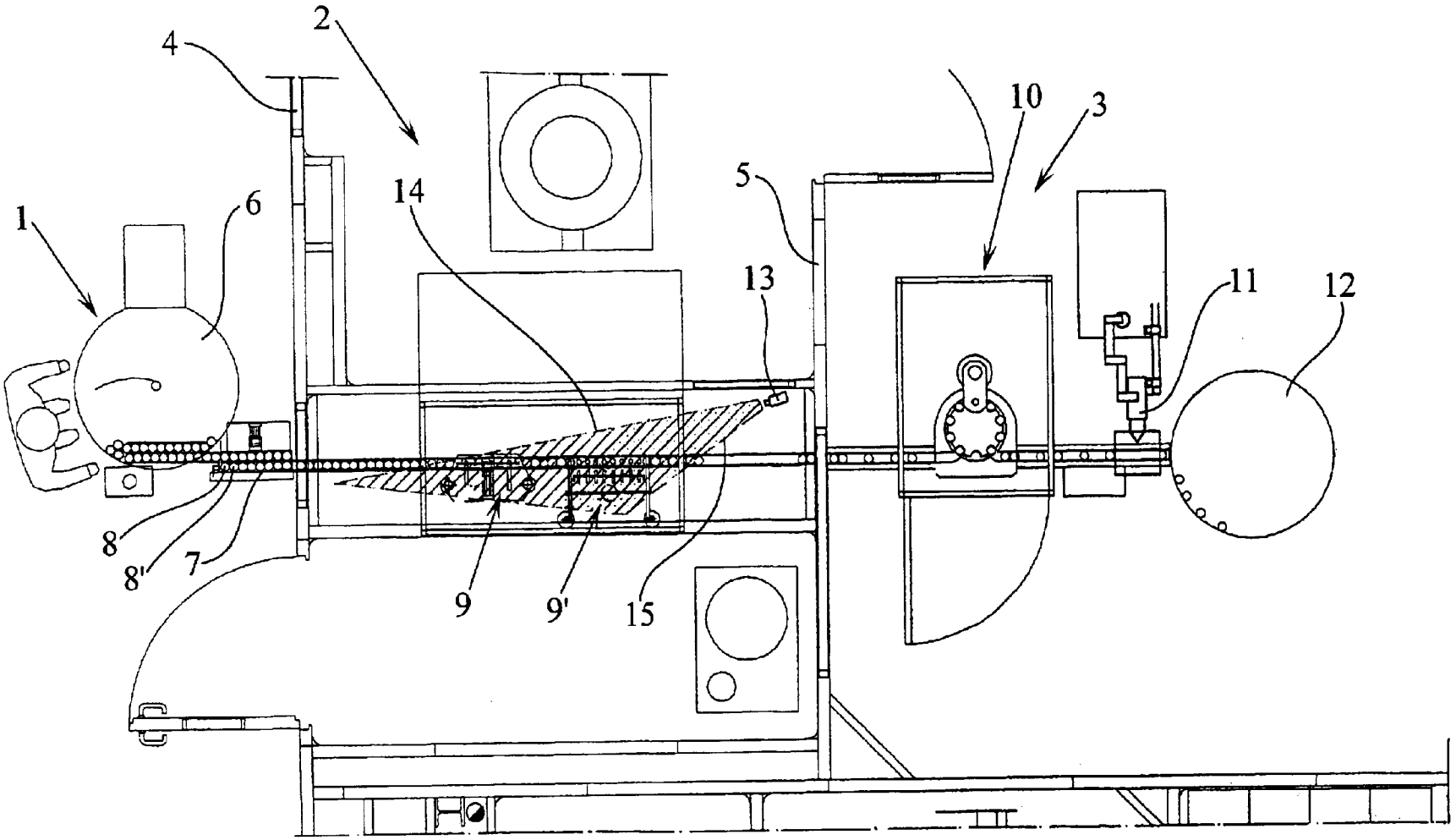
FIG. 1 shows diagrammatically in plan view a complete installation for the execution of the present invention.

As can be observed in the drawings, an installation for the execution of the present invention comprises, in a continuous line, a first feeding station 1 for feeding the containers to be filled, an intermediate zone 2 for the opening of the containers and metered filling, and a third zone 3 which comprises the container capping section and the laser marking zone. The first and second zone are separated by an intermediate partition 4, and also the zones 2 and 3 are separated by a second partition 5.

The containers, whether bottles or vials, are fed to the continuous installation by means of an entry table or plate 6 from which extend the guides 7 for the continuous installation, which carry the individual containers 8, 8'. The containers are fed to the opening and metered filling zone, in which is arranged the section 9 for the opening of the containers which, coming from an autoclave sterilization operation, arrive half-capped in this zone, in which the lid has to be separated from the container so that it can pass to the metered filling section 9', in which will be carried out the recovering of the containers, which will then pass to the capping zone 10 comprised in the end zone 3, there being carried out in said zone the placing of the closure caps on the containers which have been filled in the metered filling zone 9'. The containers then pass in front of a marking head 11, in which there is carried out by an indelible means, for example by means of laser or some other similar means, the marking of the desired data for control of the containers which have been filled, especially: batch number; hour, minute and second at which filling took place; and sequential order number. The containers are then collected on a discharge table 12. It is essential in the present invention that a video recording camera 13 is arranged in the zone for opening and metered filling of the containers, which camera covers a field of vision determined by the rays 14 and 15 indicated diagrammatically, covering the aforesaid zones for the opening of vials and for metered filling.

It is essential that there is synchronization between the television camera and the laser, or other type, marker 11, so that the recordings made with the television camera can be stored during the entire expiry period of the product, forming part of the documentation of each batch, so that the synchronization permits interrelation between the video tape recordings and the indelible markings on the glass walls of the container, making it possible to locate the part of the video recording which corresponds to the removal of the lid and the filling of each container.

Figure 2:
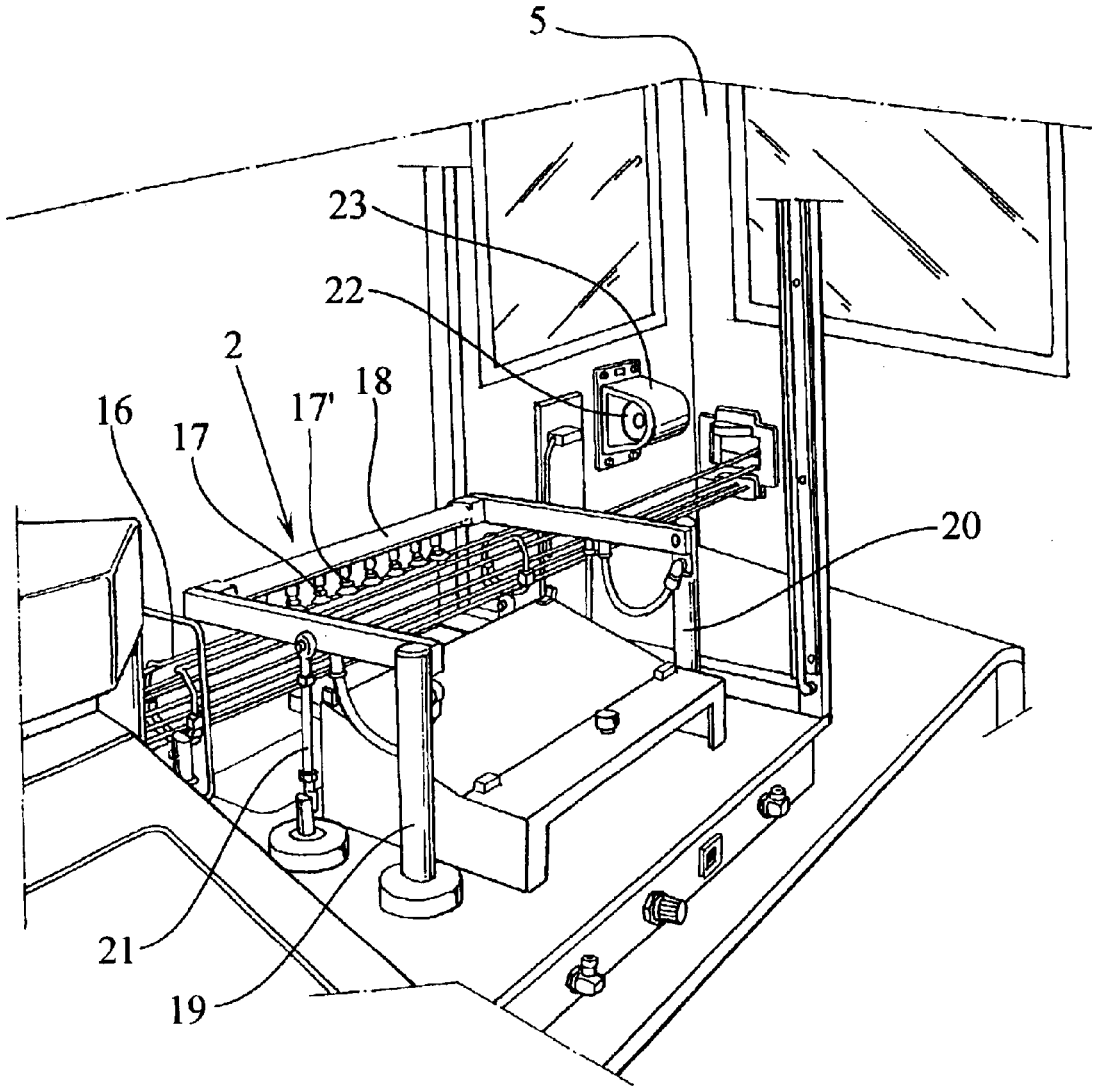
FIG. 2 is a perspective view of an exemplary embodiment of the metered filling zone.

FIG. 2 shows a detail of an embodiment of the metered filling zone in which can be seen the guide 16 for the passage of containers, which have not been shown, and which are filled by means of the nozzles 17, 17', corresponding in number to the containers filled simultaneously through said nozzles, which are mounted in a frame 18 tilting about the articulation ends on the columns 19 and 20 by the action of the vertical driving device 21. In the same view of FIG. 2, there can be seen the viewfinder 22 of a video camera, protected externally by the casing 23. In this way, the video camera can record the filling operation and also that of removal of the lids of the containers in a station preceding that shown, which is not visible in the drawing. The containers will then pass through the partition 5 which is shown in FIG. 1, passing to the capping zone and finally to the laser marking zone.

Figure 3:
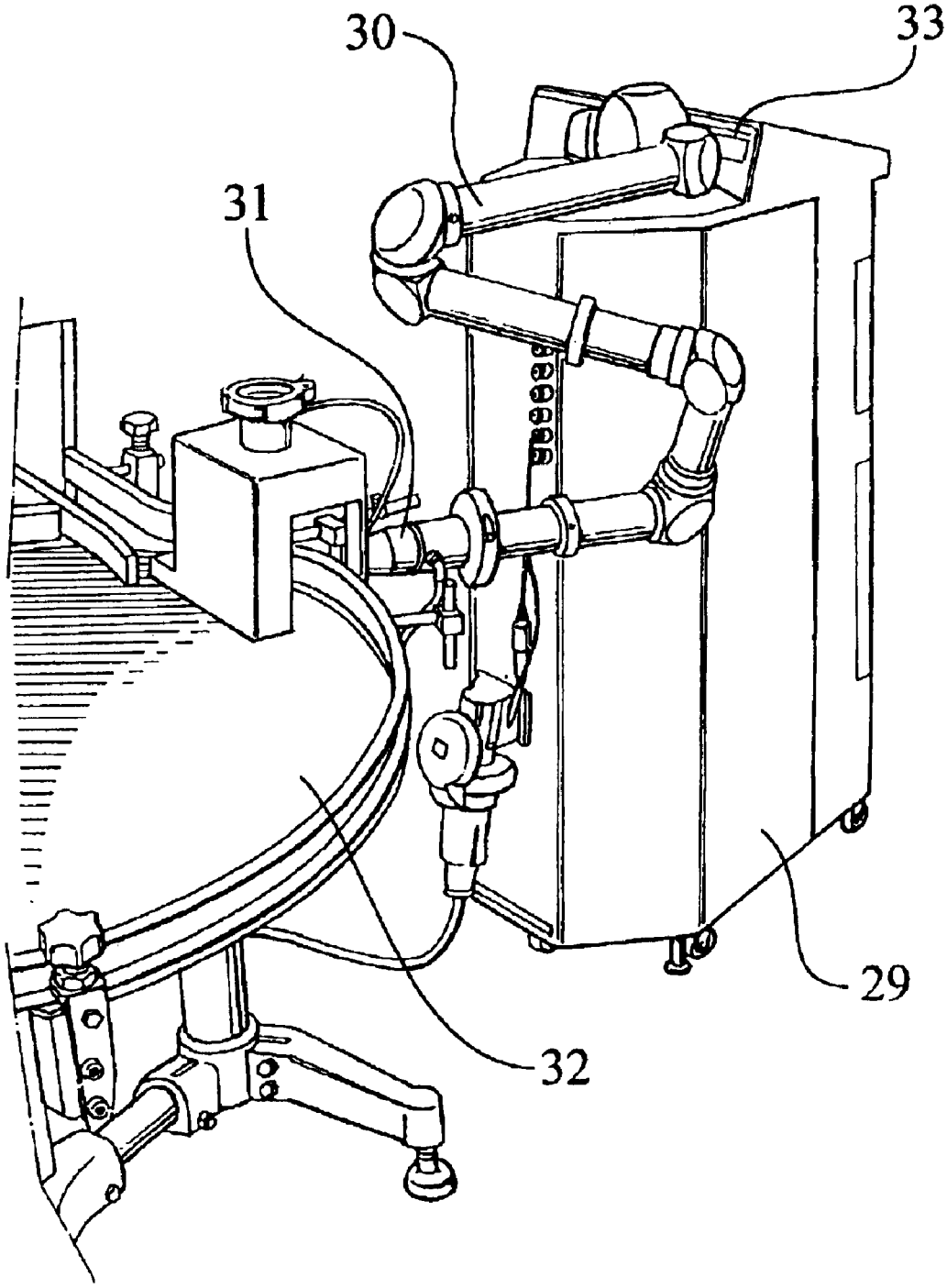
FIG. 3 is a perspective view of the marking zone.

FIG. 3 shows an embodiment of the marking device in which can be seen the control console 29 with the articulated tubes 30 for supplying a laser etching terminal 31 which acts on the containers moving in front of said head in a circle on top of the table 32. The console 29 will have a control panel 33 for the introduction of data of the inscriptions and general control of the operation.

What is claimed is:

1. A method for controlling filling of containers under aseptic conditions, comprising the steps of sterilizing the containers and the lids associated therewith, opening and metered filling of the containers, and recapping the filled containers, characterized in that said method includes the steps of continuously magnetically recording by a camera for subsequent viewing the opening and metered filling of each container, and identification marking each full container, with indelible marking means, in synchronization with the magnetic recording of such full container.

2. A method according to claim 1, characterized in that synchronization of the operation and the marking of time on the video camera or-the-like and on the walls of the glass container is carried out during the marking operation.

3. A method according to claim 1, characterized in that in the indelible marking of the full containers, the batch number, the time in hours, minutes and seconds at which marking is carried out, and a sequential order number are marked.

4. An apparatus for carrying out the method of claim 1, which comprises a work station for feeding the partially closed and sterilized empty containers to the zone for opening and metered filling of the containers, which is contained in an enclosure separated by partitions from the other zones of the installation, comprising means for opening the vials and for their metered filling, and the installation then having a capping zone and a discharge table for the full containers, characterized in that the enclosure containing the zones for opening of the containers and the zone for metered filling thereof a video camera is arranged which focuses on the section for opening of the containers and the metered filling zone, in order to enable the magnetic recording of the operations of opening of the containers and of metered filling thereof to take place continuously, with indication of the hour, minutes and seconds at which said operations are carried out, and in that said camera is synchronized with a station for indelible marking of the walls of the containers, before they emerge from the installation, whereby the recording of the operations can be viewed at a later time.

5. An apparatus according to claim 4, characterized in that the device for indelibly marking the containers is a laser marking device.

* * * * *